US008594527B2

(12) United States Patent
Nagae et al.

(10) Patent No.: US 8,594,527 B2
(45) **Date of Patent: *Nov. 26, 2013**

(54) PROCESS CARTRIDGE HAVING TONER SCATTER PREVENTING SHEET AND PHOTOELECTROGRAPHIC IMAGE FORMING APPARATUS

(71) Applicant: Canon Kabushiki Kaisha, Tokyo (JP)

(72) Inventors: Hideki Nagae, Numazu (JP); Masaaki Sato, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/767,787

(22) Filed: Feb. 14, 2013

(65) Prior Publication Data

US 2013/0156460 A1 Jun. 20, 2013

Related U.S. Application Data

(63) Continuation of application No. 12/472,355, filed on May 26, 2009, now Pat. No. 8,401,420.

(30) Foreign Application Priority Data

May 27, 2008 (JP) ..... 2008-138246
Sep. 26, 2008 (JP) ..... 2008-248069

(51) Int. Cl.
*G03G 15/00* (2006.01)
*G03G 21/18* (2006.01)

(52) U.S. Cl.
USPC ..... 399/96; 399/111

(58) Field of Classification Search
USPC ..... 399/113, 114, 111, 98, 103, 105
See application file for complete search history.

(56) References Cited

U.S. PATENT DOCUMENTS 6,256,466 B1 * 7/2001 Ota et al. ..... 399/103
8,401,420 B2 * 3/2013 Nagae et al. ..... 399/98
2005/0008391 A1 * 1/2005 Ueno et al.
2005/0008401 A1 * 1/2005 Kawamura et al.

* cited by examiner

*Primary Examiner* — Susan Lee
(74) *Attorney, Agent, or Firm* — Canon USA Inc. IP Division

(57) ABSTRACT

A process cartridge attachable to and detachable from an electrophotographic image forming apparatus includes a first unit having an electrophotographic photosensitive member, and a second unit including a developing roller configured to develop a latent image formed on the electrophotographic photosensitive member, and a sheet member which is disposed along the developing roller in a lengthwise direction of the developing roller and contacts the electrophotographic photosensitive member to restrain scattering of developer. The second unit is movably connected to the first unit and can move between a contact position in which the developing roller contacts the electrophotographic photosensitive member and a separated position in which the developing roller separates from the electrophotographic photosensitive member. The sheet member is arranged so that the sheet member contacts the electrophotographic photosensitive member when the second unit is positioned at the contact position and when the second unit is positioned at the separated position.

12 Claims, 7 Drawing Sheets

PROCESS CARTRIDGE HAVING TONER SCATTER PREVENTING SHEET AND PHOTOELECTROGRAPHIC IMAGE FORMING APPARATUS

CROSS-REFERENCE TO RELATED APPLICATIONS

This application is a continuation of U.S. patent application Ser. No. 12/472,355 filed May 26, 2009, which claims priority from Japanese Patent Application Nos. 2008-138246 filed May 27, 2008, and 2008-248069 filed Sep. 26, 2008, all of which are hereby incorporated by reference herein in their entireties.

BACKGROUND OF THE INVENTION

1. Field of the Invention

The present invention relates to a process cartridge and an electrophotographic image forming apparatus that uses the process cartridge.

The electrophotographic image forming apparatus denotes an apparatus that forms images on a recording medium by using an electrophotographic image forming method. As examples of the image forming apparatus, there are electrophotographic copying machines, electrophotographic printers, such as a laser beam printer and an LED printer, facsimile machines, and word processors.

The process cartridge denotes a cartridge integrally combining at least a developing unit and an electrophotographic photosensitive member as an image forming process unit. This process cartridge can be attached to and detached from the image forming apparatus body.

2. Description of the Related Art

If developer (toner) falls or scatters from the developing unit and the process cartridge, the inside of the image forming apparatus may be contaminated by the developer, and bad effects may occur to images.

Therefore, it has been proposed to install a scattered developer container to collect the falling or scattering developer in a conventional image forming apparatus, a developing unit or a process cartridge. More specifically, for example, Japanese Patent Application Laid-Open No. 5-53434 discusses a scattered developer container formed integrally with the development blade and provided under the development blade.

This scattered developer container collects developer that scatters out from the edge of the development blade. An insulating elastic sheet, one edge of which is fixed to the entry side end of the bottom plate of the scattered developer container, is provided. The other edge of the insulating elastic sheet slidingly contacts the photosensitive drum. This insulating elastic sheet securely can prevent entry of the scattering toner into the image forming apparatus.

This development blade forms a thin layer of the developer that is supplied from the developer container to the developing roller.

SUMMARY OF THE INVENTION

The present invention is directed to suppressing vibration or noise of the sheet member, which occurs when the sheet member slidingly contacts the electrophotographic photosensitive member.

According to an aspect of the present invention, a process cartridge attachable to and detachable from an electrophotographic image forming apparatus includes a first unit having an electrophotographic photosensitive member, and a second unit including a developing roller configured to develop a latent image formed on the electrophotographic photosensitive member, and a sheet member which is disposed along the developing roller in a lengthwise direction of the developing roller and contacts the electrophotographic photosensitive member to restrain scattering of developer, wherein a contact portion of the sheet member that contacts the electrophotographic photosensitive member is roughened by a roughening process.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

An image forming apparatus, a developing unit attachable to and detachable from the image forming apparatus, and a process cartridge (hereafter referred to as a cartridge) attachable to and detachable from the image forming apparatus according to a first exemplary embodiment of the present invention will be described below.

The overall configuration of the image forming apparatus capable of forming an image on a recording medium is described with reference to FIG. 2.

Figure 4:
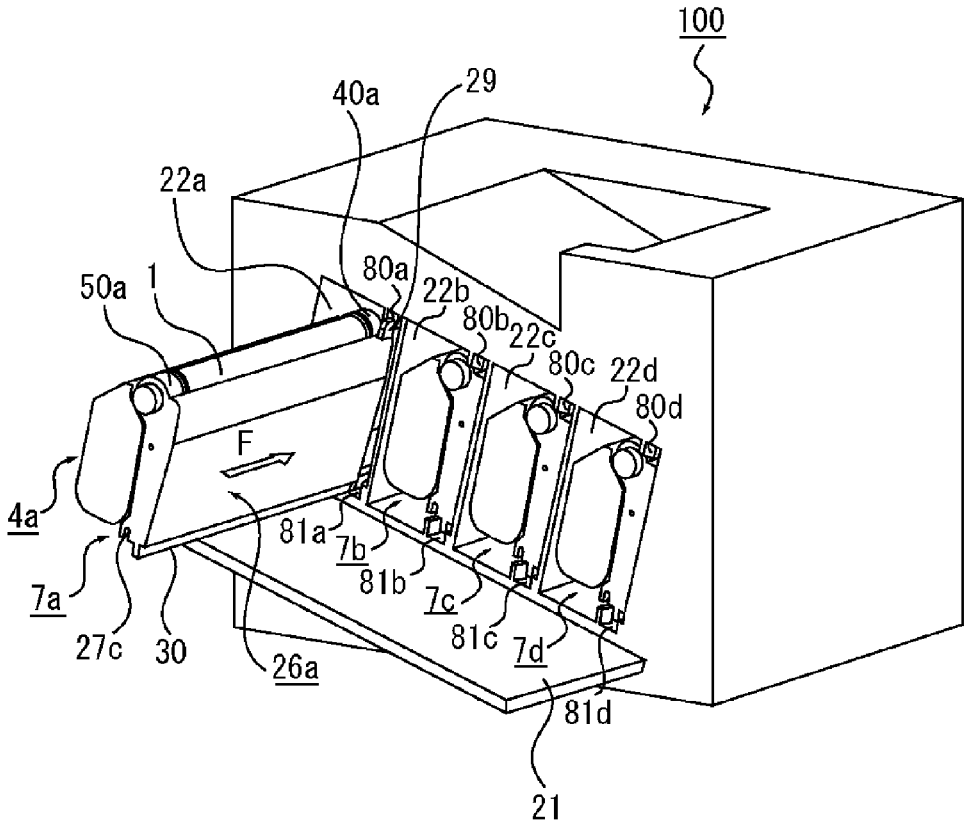
FIG. 4 is a perspective view illustrating the state of the color electrophotographic image forming apparatus before the cartridge is mounted therein.

A color electrophotographic image forming apparatus (hereinafter referred to as an image forming apparatus) 100 illustrated in FIG. 2 includes four mounting unit 22 (22*a* to 22*d*) illustrated in FIG. 4 to mount four cartridges in such a manner that they are arranged in parallel and inclined by an angle relative to horizontal.

Each of the cartridge 7 (7*a*-7*d*) mounted on the mounting unit 22 (22*a* to 22*d*) includes an electrophtographic photosensitive drum 1 (1*a* to 1*d*) as an electrophotographic photosensitive member.

The electrophotographic photosensitive drum 1 (hereafter referred to as a photosensitive drum) is rotated in a clockwise direction (the arrow Q direction in FIG. 2) by a drive member (not shown). Around the photosensitive drum 1, the process units working on the photosensitive drum are disposed in the order of drum rotating direction as described below.

The process units include a cleaning member 6 (6*a*-6*d*) to remove the developer (hereafter referred to as toner) remaining on the surface of the photosensitive drum 1 after transfer, a charging roller 2 (2*a*-2*d*) to uniformly charge the surface of the photosensitive drum 1, and a developing unit 4 (4*a*-4*d*) as a second unit for developing the electrostatic latent image by using toner.

The image forming apparatus 100 further includes a scanner unit 3, disposed below the photosensitive drum 1, which emits a laser beam according to image information to form an electrostatic latent image on the photosensitive drum 1, and an intermediate transfer belt 5 on which a four-color toner image formed on the photosensitive drum 1 is transferred.

The photosensitive drum 1, the cleaning member 6, the charging roller 2, and the developing unit 4 are combined integrally into a cartridge 7. The cartridge 7 can be mounted on and detached from the main body 100*a* of the image forming apparatus 100 by the user.

The intermediate transfer belt 5 is stretched around a drive roller 10 and a tension roller 11.

Primary transfer rollers 12*a* to 12*d* are arranged opposing to and above each of the photosensitive drums 1*a* to 1*d* on the inner surface of the intermediate transfer belt 5. A transfer bias is applied to the intermediate transfer belt 5 by a bias voltage application unit (not illustrated).

The toner images formed on the photosensitive drums 1 are primary transferred onto the intermediate transfer belt 5 in sequence as the respective photosensitive drums 1 rotate in the arrow Q direction, and the intermediate transfer belt 5 rotates in the arrow R direction, and also a positive polarity bias is applied to the primary transfer rollers 12.

A superposed four color toner image formed on the intermediate transfer belt 5 is conveyed to a secondary transfer unit 15.

In synchronization with the image forming operation, a sheet S (a recording medium) is conveyed by a conveyance unit including a feeding device 13 and a registration roller pair 17. The feeding device 13 includes a feeding cassette 24 to store sheets S, a delivery roller 8 to feed sheets S, and a conveyance roller pair 16 to convey the sheets S.

Figure 2:
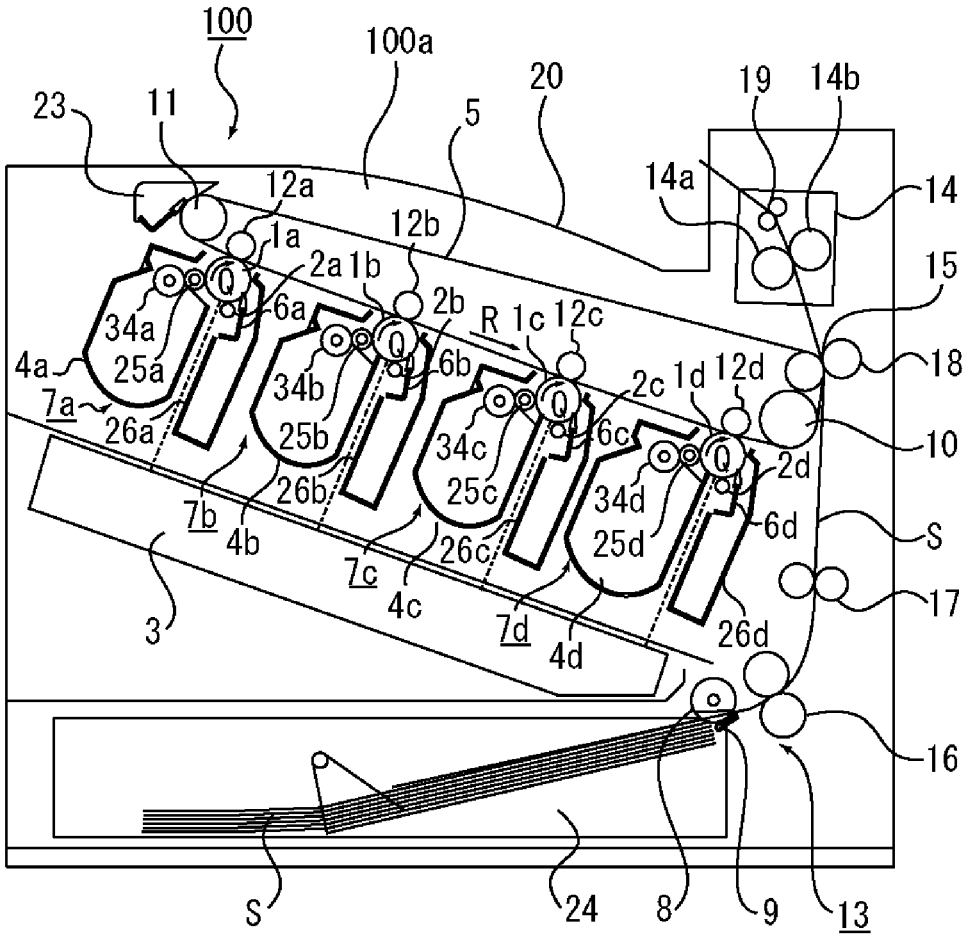
FIG. 2 illustrates an overall configuration of a color electrophotographic image forming apparatus according to an exemplary embodiment of the present invention.

The feeding cassette 24 can be pulled out from the main body in FIG. 2. The sheets S stacked in the feeding cassette 24 are pressed against the delivery roller 8, separated one by one by a separation pad 9 (separation pad method), and conveyed.

A sheet S conveyed by the feeding device 13 is conveyed to the secondary transfer unit 15 by the registration roller pair 17. The secondary transfer unit 15 applies a positive polarity bias to a secondary transfer roller 18. Consequently, a four color toner image formed on the intermediate transfer belt 5 is secondary transferred onto the conveyed sheet S.

A fixing unit 14 fixes a toner image formed on the sheet S by applying heat and pressure. A fixing belt 14*a*, which is cylindrical in shape, is guided by a belt guide member (not illustrated) with a heat generator (a heater). A fixing nip portion is formed by the fixing belt 14*a* and a pressure roller 14*b* with a predetermined pressure contact force.

The conveyed sheet S from the image forming section with an unfixed toner image is heated and pressed at the fixing nip between the fixing belt 14*a* and the pressure roller 14*b*.

Thus, the unfixed toner image on the sheet S is fixed to the sheet S. Then, the sheet S having the fixed toner image is discharged onto a discharge tray 20 by a discharge roller pair 19.

On the other hand, after the toner image has been transferred, the toner remaining on the surface of the photosensitive drum 1 is removed by the cleaning member 6. The removed toner is collected in a removed toner chamber 27*a* in each photosensitive unit 26 (26*a*-26*d*).

After secondary transfer of the image to the sheet S, the residual toner on the intermediate transfer belt 5 is removed by a transfer belt cleaning member 23. The removed toner is collected into a waste toner container (not illustrated) arranged at the backside of the apparatus via a waste toner conveyance path (not illustrated).

Figure 3:
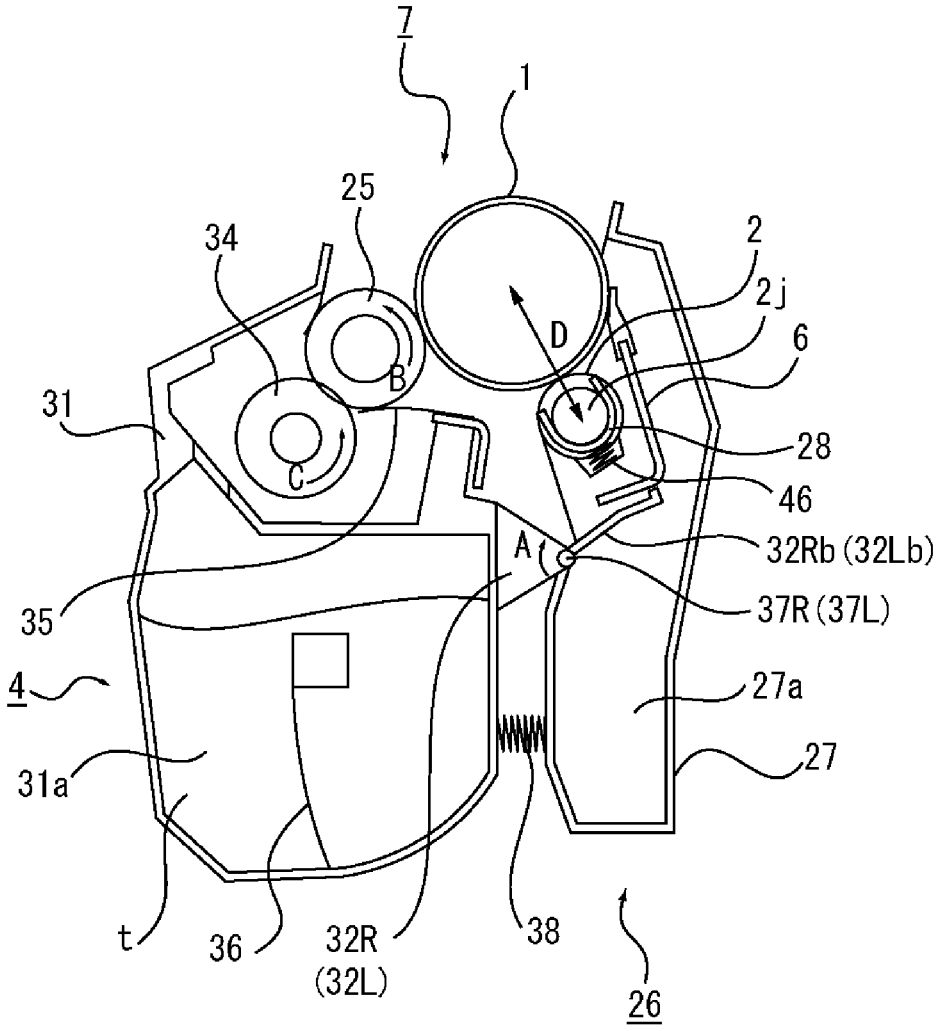
FIG. 3 is a cross-sectional diagram of the cross section of the cartridge.

The cartridge according to the exemplary embodiment of the present invention is described with reference to FIG. 3. FIG. 3 illustrates a principal section of the cartridge 7 that contains toner t. A cartridge 7*a* that contains a yellow toner t, a cartridge 7*b* that contains a magenta toner t, a cartridge 7*c* that contains a cyan toner, and a cartridge 7*d* that contains a black toner t are similarly configured.

The cartridge 7 includes a photosensitive unit 26, which includes the photosensitive drum 1, the charging roller 2, and the cleaning member 6, and the developing unit 4, which includes a developing roller 25.

The photosensitive drum 1 is rotatably mounted via a bearing, which will be described later, to a cleaning frame member 27 of the photosensitive unit 26. The photosensitive drum 1 is rotated according to an image forming operation as the drive force of a drive motor (not shown) is applied to the photosensitive unit 26.

As described above, the charging roller 2 and the cleaning member 6 are disposed on the circumference of the photosensitive drum 1. The residual toner, removed from the surface of the photosensitive drum 1 by the cleaning member 6, falls into the removed toner chamber 27*a*.

A charging roller bearing 28 is mounted to the cleaning frame member 27 in such a manner that the bearing 28 can move in the arrow D direction that passes through both the center of the charging roller 2 and the center of the photosensitive drum 1. A shaft 2*j* of the charging roller 2 is rotatably mounted to the bearing 28. The charging roller bearing 28 is pressed toward the photosensitive drum 1 by a charging roller pressure member 46.

The developing unit 4 includes the developing roller 25 that contacts the photosensitive drum 1 and rotates in the arrow B direction, and a development frame member 31. The developing roller 25 is rotatably supported by the development frame member 31 via bearing members 32R and 32L at both sides of the development frame member 31 in the lengthwise direction.

A toner supply roller 34 that contacts the developing roller 25 and rotates in the arrow C direction, and a development blade 35 to regulate the toner layer on the developing roller 25 are disposed on the circumference of the developing roller 25.

A toner container 31*a* of the development frame member 31 includes a toner conveyance member 36 to stir the contained toner and conveys the toner to the toner supply roller 34.

The developing unit 4, which is rotatably connected to the photosensitive unit 26, rotates about the center of the shaft 37 (37R and 37L) respectively fitted in holes 32R*b* and 32L*b* formed in the bearing members 32R and 32L. The developing unit 4 is urged by a pressure spring 38.

Therefore, during an image forming operation in the cartridge 7, the developing unit 4 rotates about the shaft 37 in the arrow "A" direction, and the developing roller 25 is in contact with the photosensitive drum 1.

The toner is formed into a thin layer on the surface of the developing roller 25 by the development blade 35, and conveyed to the image forming portion as the developing roller 25 rotates where the photosensitive drum 1 and the developing roller 25 face each other.

The image forming portion is where the photosensitive drum 1 and the developing roller 25 are in contact with each other. In the image forming portion, by a developing bias voltage applied to the developing roller 25 from a power supply (not illustrated), the developer on the developing roller 25 adheres to the electrostatic latent image on the surface of the photosensitive drum 1, and thereby the latent image is developed into a visible toner image.

The developer remaining on the surface of the developing roller 40 without contributing to the development of the electrostatic latent image is returned to the developing unit 4 as a developing roller 40 rotates.

In the exemplary embodiment of the present invention, the cartridge 7 employs a contact development process in which a latent image is developed while the developing roller 25 is in contact with the photosensitive drum 1. In this case, during an image forming operation, the elastic layer 25*a* of the developing roller 25 is kept in contact with the photosensitive drum 1 by a predetermined contact pressure.

Therefore, when the cartridge 7 is mounted in the image forming apparatus main body 100 and not used for a long time, the elastic layer 25*a* of each developing roller 25 may be deformed permanently, and unevenness may occur in an image.

To solve this problem, a separation mechanism is provided to separate the developing roller 25 from the photosensitive drum 1 when an image forming operation is not performed.

The separation mechanism for separating the photosensitive drum 1 and the developing roller 25 in the cartridge 7 according to the present invention is described with reference to FIGS. 5 and 6.

Figure 5:
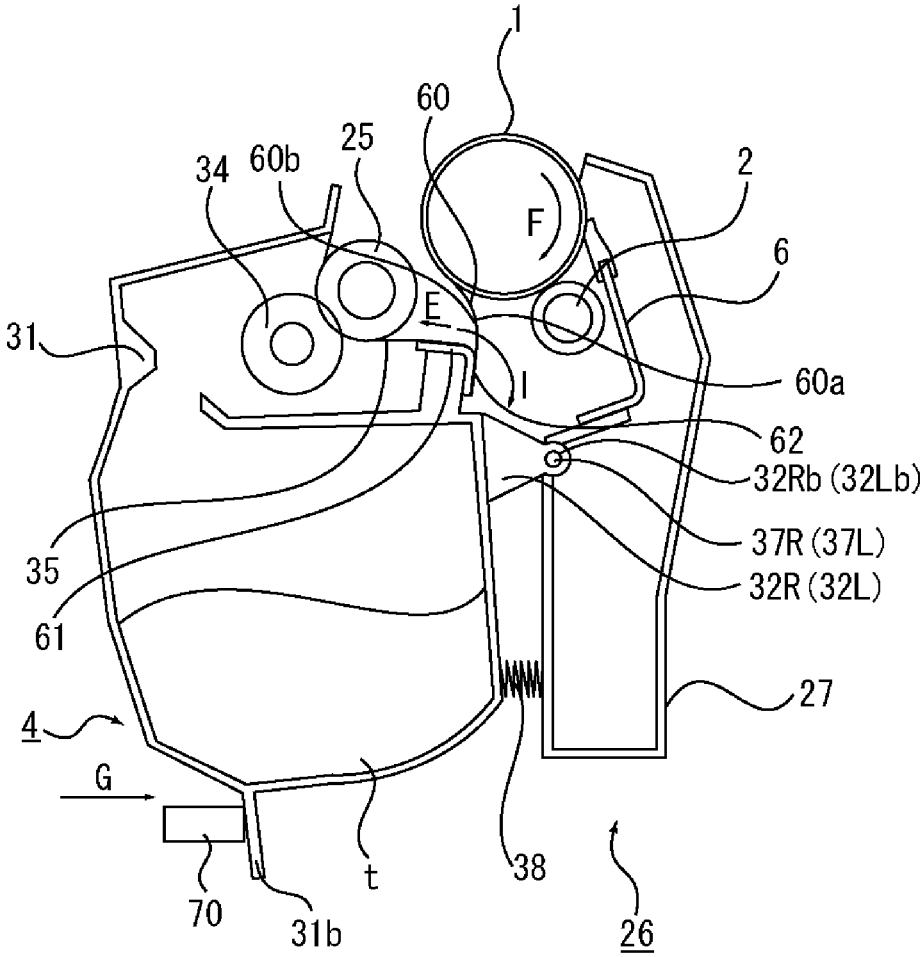
FIG. 5 is a sectional view illustrating the cartridge when a developing roller is separated from the photosensitive drum.

In FIG. 5, a separating member 70 is disposed at approximately the middle of the cartridge 7 in the lengthwise direction in the image forming apparatus 100. A force receptor 31*b* of the development frame member 31 receives a force as the separating member 70 moves in the arrow G direction.

At this time, the developing unit 4 of the cartridge 7 rotates about the center of the shaft 37 (37R and 37L) fitted respectively in holes 32R*b* and 32L*b* formed in the bearing members 32R and 32L and moves the developing roller 25 to the separated position where the developing roller 25 is separated from the photosensitive drum 1.

Figure 6:
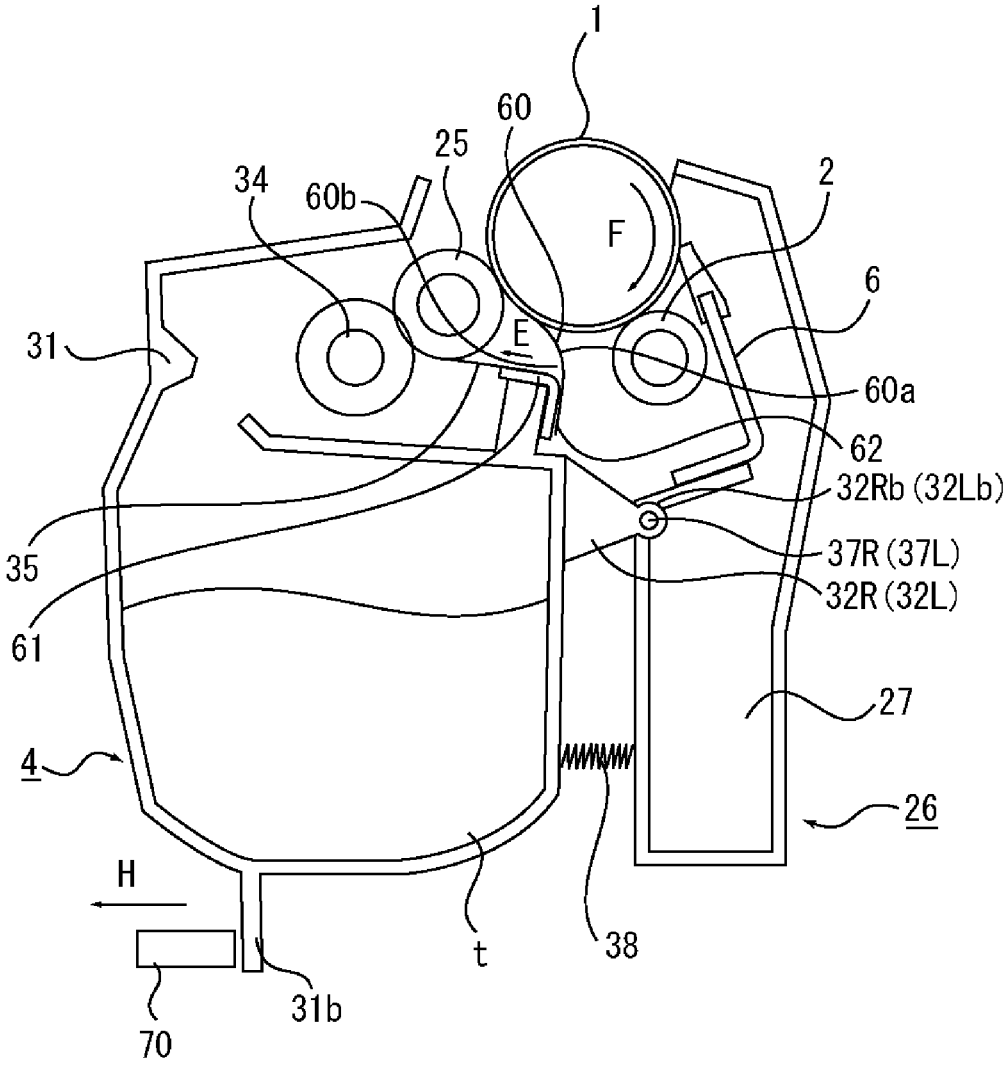
FIG. 6 is sectional view illustrating the cartridge when the developing roller is in contact with the photosensitive drum.

As illustrated in FIG. 6, when the separating member 70 moves in the arrow H direction and separates from the force receptor 31*b*, by an urging force generated by a pressure spring 38 and a tension spring (not illustrated), the developing unit 4 rotates about the center of the shaft (37R, 37L) fitted in the holes 32R*b* and 32L*b* formed in the bearing members 32R, 32L.

The developing roller 25 moves in the arrow T direction and comes to the contact position where the developing roller 25 contacts the photosensitive drum 1.

Next, the sheet member to restrain falling and scattering of the toner according to the first exemplary embodiment of the present invention is described.

Figure 1:
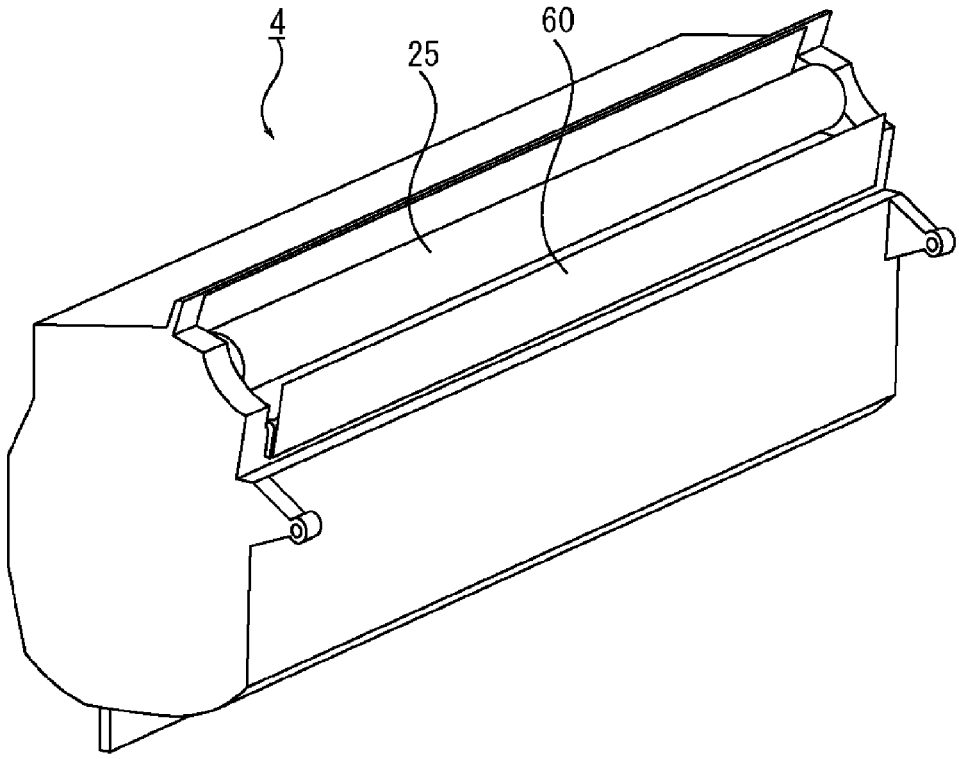
FIG. 1 is a perspective view of a developing unit in which a sheet member is mounted.

As illustrated in FIG. 1, a sheet member 60 is attached to the developing unit 4. The sheet member 60 is provided along the lengthwise direction of the developing roller 25.

Figure 7:
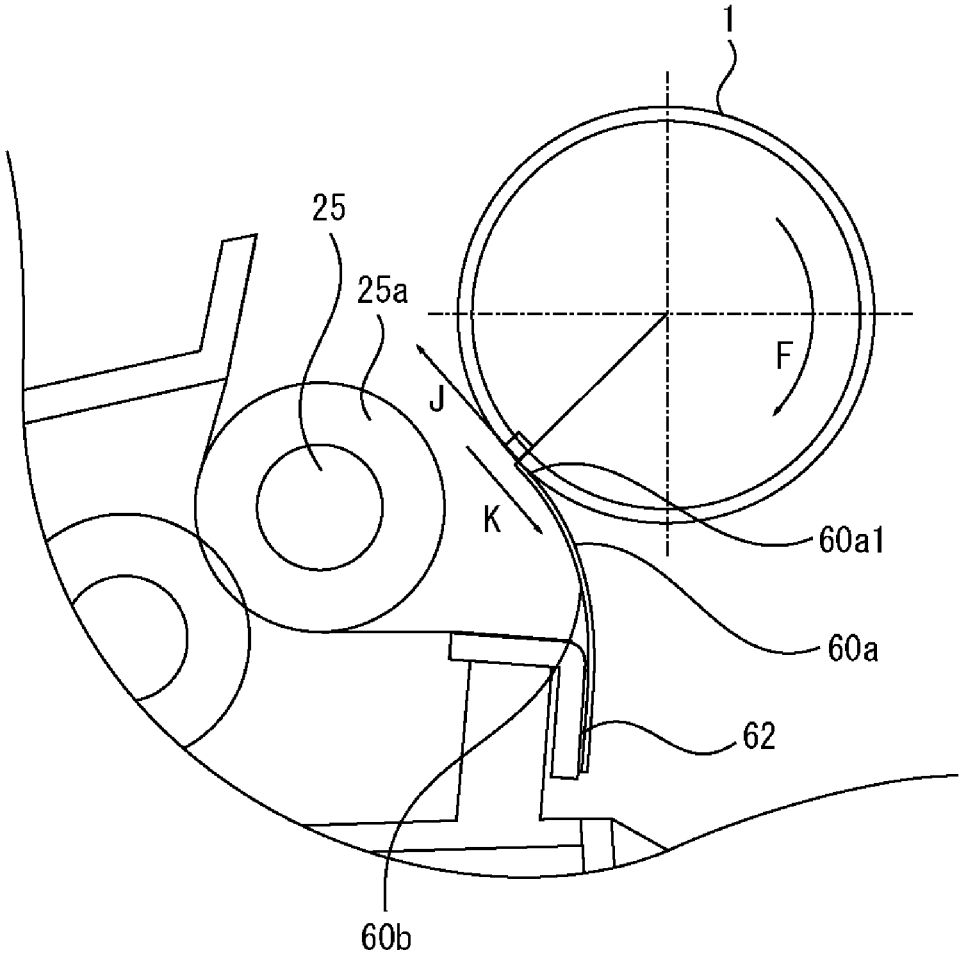
FIG. 7 is a sectional view illustrating the sheet member.

As illustrated in FIGS. 5 and 7, one edge of the of the sheet member 60 in widthwise direction is fixed to a development blade attachment plate 61 by using a two-sided adhesive tape 62. The sheet member 60 is mounted so that the other edge of the sheet member 60 in the widthwise direction faces the photosensitive drum 1 and contacts the surface layer of the photosensitive drum 1.

The sheet member 60 is mounted so that it does not to contact the developing roller 25. The sheet member 60 bends in the arrow E direction by contacting the surface of the photosensitive drum 1.

The sheet member 60 receives the toner that falls from the exposed portion of the developing roller 25, and thus suppresses falling and scattering of the toner to the outside (arrow I direction) of the cartridge 7.

In this exemplary embodiment, as a material for the sheet member 60, polyethylene terephthalate sheet in a thickness of 50 μm is used. However, other materials such as polycarbonate or polyurethane may be used. Further, these materials in a different thickness may be used.

Between the separated position and the contact position, the developing unit 4 of the process cartridge 7 rotates about the center of the shaft 37 (37R and 37L) fitted in the holes 32R*b* and 32L*b* formed in the bearing members 32R and 32L.

Regardless of which position, the separated position or the contact position, the developing unit 4 of the process cartridge 7 may be positioned, the other edge of the sheet member 60 in the widthwise direction is kept in contact with the surface layer of the photosensitive drum 1.

Wherever the developing unit 4 of the cartridge 7 may be between the separated position and the contact position while the developing unit 4 rotates, the other edge of the sheet member 60 along the widthwise direction is kept in contact with the surface layer of the photosensitive drum 1.

While the developing unit 4 is rotated between the separated position and the contact position, the photosensitive drum 1 can be rotated.

In the exemplary embodiment of the present invention, among the surface 60*a* of the sheet member 60, a contact portion 60*a*1, which contacts the surface layer of the photosensitive drum 1, is given roughing processing. The portions other than the contact portion 60*a*1 of the surface 60*a* and the rear side 60*b* of the sheet member 60 do not contact the photosensitive drum 1 and therefore roughing is not needed.

In the exemplary embodiment, the contact portion 60*a*1 is given roughing by sand blasting.

In the configuration described above, if the contact portion 60*a*1 of the sheet member 60 that contacts the photosensitive drum 1 has a smooth surface, when the photosensitive drum 1 is rotated in the arrow F direction as illustrated in FIG. 7, the sheet member 60 vibrates.

This is due to the following reason. First, the contact portion 60*a*1 is scraped by abrasion with the photosensitive drum 1. AS a result, the contact area between the contact portion 60*a*1 and the photosensitive drum 1 becomes larger. The increased contact area causes the increase of the frictional force between the contact portion 60*a*1 and the photosensitive drum 1. Therefore, the sheet member 60 is pulled in the arrow J direction, illustrated in FIG. 7, which is the tangential direction of the photosensitive drum 1.

As the sheet member 60 is pulled further in the arrow J direction, the recovery force of the sheet member 60 itself increases and the recovery force of the sheet member 60 becomes greater than the frictional force between the sheet member 60 and the photosensitive drum 1. As a result, the sheet member 60 returns to the arrow K direction.

As the above-described movement is repeatedly performed, the sheet member 60 keeps vibrating, thereby generating noise.

In this exemplary embodiment, because the contact portion 60*a*1 undergoes a roughening process, the contact area between the sheet member 60 and the photosensitive drum 1 decreases. Since the contact portion 60*a*1 is roughened, its scraped amount caused by abrasion with the photosensitive drum 1 is reduced, and the contact area between the sheet member 60 and the photosensitive drum 1 hardly changes.

Therefore, because the frictional force between the sheet member 60 and the photosensitive drum 1 does not increase, even if the photosensitive drum 1 is rotated while the sheet member 60 is kept in contact with the photosensitive drum 1, the sheet member is not pulled in the arrow J direction.

Consequently, the vibration of the sheet member 60 caused by the abrasion with the photosensitive drum 1 and noise due to the vibration can be restrained.

In the above configuration, according to experimental data, if the arithmetic average roughness Ra (JIS B0601-1994) of the contact portion 60*a*1 is 0.04, the sheet member 60 vibrates and noise is generated.

If the arithmetic average roughness Ra of the contact portion 60*a*1 is 0.35 to 0.8, the sheet member 60 does not vibrate. Therefore, the arithmetic average roughness Ra is preferably larger than 0.04.

However, if the roughness of the contact portion 60*a*1 is too large, the toner passes through the contact portion 60*a*1 with the photosensitive drum 1, and falls and scatters to the outside of the cartridge 7 (in the arrow I direction in FIG. 5). To prevent this, the arithmetic average roughness Ra is desirably smaller than the particle size of the toner particles.

In the exemplary embodiment, it has been confirmed that if the Ra is equal to or larger than 1.0, the toner does not fall or scatter. In addition, in the exemplary embodiment, for the roughening process of the contact portion 60*a*1, sand blasting is used, but component rolling processing may be used.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A process cartridge attachable to and detachable from an electrophotographic image forming apparatus, the process cartridge comprising:

a first unit having an electrophotographic photosensitive member; and a second unit including a developing roller configured to develop a latent image formed on the electrophotographic photosensitive member, and a sheet member which is disposed along the developing roller in a lengthwise direction of the developing roller and contacts the electrophotographic photosensitive member to restrain scattering of developer, wherein the second unit is movably connected to the first unit and can move between a contact position in which the developing roller contacts the electrophotographic photosensitive member and a separated position in which the developing roller separates from the electrophotographic photosensitive member, and wherein the sheet member is arranged so that the sheet member contacts the electrophotographic photosensitive member when the second unit is positioned at the contact position and when the second unit is positioned at the separated position.

2. The process cartridge according to claim 1, wherein the sheet member contacts the electrophotographic photosensitive member on an upstream side of a contact portion where the electrophotographic photosensitive member contacts the developing roller in a rotation direction of the electrophotographic photosensitive member.

3. A process cartridge attachable to and detachable from an electrophotographic image forming apparatus, the process cartridge comprising:

a first unit having an electrophotographic photosensitive member; and a second unit including a developing roller configured to develop a latent image formed on the electrophotographic photosensitive member, and a sheet member which is disposed along the developing roller in a lengthwise direction of the developing roller and contacts the electrophotographic photosensitive member to restrain scattering of developer, wherein a contact portion of the sheet member that contacts the electrophotographic photosensitive member has an arithmetic average height of greater than 0.04 and not greater than 1.0.

4. The process cartridge according to claim 3, wherein the sheet member contacts the electrophotographic photosensitive member on an upstream side of a contact portion where the electrophotographic photosensitive member contacts the developing roller in a rotation direction of the electrophotographic photosensitive member.

5. A process cartridge attachable to and detachable from an electrophotographic image forming apparatus, the process cartridge comprising:

a first unit having an electrophotographic photosensitive member; and a second unit including a developing roller configured to develop a latent image formed on the electrophotographic photosensitive member, and a sheet member which is disposed along the developing roller in a lengthwise direction of the developing roller to restrain scattering of developer and which contacts the electrophotographic photosensitive member, wherein polyethylene terephthalate or polycarbonate is used as a material for the sheet member.

6. The process cartridge according to claim 5, wherein the sheet member contacts the electrophotographic photosensitive member on an upstream side of a contact portion where the electrophotographic photosensitive member contacts the developing roller in a rotation direction of the electrophotographic photosensitive member.

7. An electrophotographic image forming apparatus for forming an image on a recording medium, comprising:

an exposure unit;

a first unit having an electrophotographic photosensitive member;

a second unit including a developing roller configured to develop a latent image formed on the electrophotographic photosensitive member and a sheet member configured to contact the electrophotographic photosensitive member, and to be arranged along a lengthwise direction of the developing roller to restrain scattering of developer from the developing roller to the exposure unit, wherein the second unit is movably connected to the first unit and can move between a contact position in which the developing roller contacts the electrophotographic photosensitive member and a separated position in which the developing roller separates from the electrophotographic photosensitive member, and wherein the sheet member is arranged so that the sheet member contacts the electrophotographic photosensitive member when the second unit is positioned at the contact position and when the second unit is positioned at the separated position.

8. The electrophotographic image forming apparatus according to claim 7, wherein the sheet member contacts the electrophotographic photosensitive member on an upstream side of a contact portion where the electrophotographic photosensitive member contacts the developing roller in a rotation direction of the electrophotographic photosensitive member.

9. An electrophotographic image forming apparatus for forming an image on a recording medium, comprising:

an electrophotographic photosensitive member;

a developing roller configured to develop a latent image formed on the electrophotographic photosensitive member;

an exposure unit; and a sheet member configured to contact the electrophotographic photosensitive member, and to be arranged along the lengthwise direction of the developing roller to restrain scattering of developer from the developing roller to the exposure unit, wherein a contact portion of the sheet member that contacts the electrophotographic photosensitive member has an arithmetic average height of greater than 0.04 and not greater than 1.0.

10. The electrophotographic image forming apparatus according to claim 9, wherein the sheet member contacts the electrophotographic photosensitive member on an upstream side of a contact portion where the electrophotographic photosensitive member contacts the developing roller in a rotation direction of the electrophotographic photosensitive member.

11. An electrophotographic image forming apparatus for forming an image on a recording medium, comprising:

an electrophotographic photosensitive member;

a developing roller configured to develop a latent image formed on the electrophotographic photosensitive member;

an exposure unit; and a sheet member configured to contact the electrophotographic photosensitive member, and to be arranged along a lengthwise direction of the developing roller to restrain scattering of developer from the developing roller to the exposure unit, wherein polyethylene terephthalate or polycarbonate is used as a material for the sheet member.

12. The electrophotographic image forming apparatus according to claim 11, wherein the sheet member contacts the electrophotographic photosensitive member on an upstream side of a contact portion where the electrophotographic photosensitive member contacts the developing roller in a rotation direction of the electrophotographic photosensitive member.

* * * * *